US008550445B2

(12) United States Patent
Hayano

(10) Patent No.: US 8,550,445 B2
(45) Date of Patent: Oct. 8, 2013

(54) AUTOMATIC DOCUMENT FEEDER AND IMAGE FORMING APPARATUS PROVIDED WITH SUCH AUTOMATIC DOCUMENT FEEDER

(75) Inventor: Satoshi Hayano, Osaka (JP)

(73) Assignee: Kyocera Mita Corporation (JP)

( * ) Notice: Subject to any disclaimer, the term of this patent is extended or adjusted under 35 U.S.C. 154(b) by 664 days.

(21) Appl. No.: 12/192,518

(22) Filed: Aug. 15, 2008

(65) Prior Publication Data

US 2009/0051106 A1 Feb. 26, 2009

(30) Foreign Application Priority Data

Aug. 21, 2007 (JP) ..... 2007-215051

(51) Int. Cl.
*B65H 5/22* (2006.01)
*B65H 83/00* (2006.01)
*B65H 85/00* (2006.01)

(52) U.S. Cl.
USPC ..... 271/3.14; 271/264

(58) Field of Classification Search
USPC ..... 271/3.01, 3.05, 3.08, 3.14, 4.01, 10.01, 271/264; 358/498, 496; 399/367
See application file for complete search history.

(56) References Cited

U.S. PATENT DOCUMENTS 5,992,841 A * 11/1999 Fujii et al. ..... 271/3.02
7,020,429 B2 * 3/2006 Hamada et al. ..... 399/367
7,320,462 B2 * 1/2008 Takamatsu ..... 271/3.14
2004/0026848 A1 * 2/2004 Klapp et al. ..... 271/264
2004/0178566 A1 * 9/2004 Kulpa ..... 271/226
2005/0146089 A1 * 7/2005 Emanuel ..... 271/264
2006/0071386 A1 * 4/2006 Mizubata et al. ..... 271/3.14
2006/0180972 A1 * 8/2006 Suzuki ..... 271/3.14
2007/0063430 A1 * 3/2007 Sakakibara et al. ..... 271/264
2007/0064285 A1 * 3/2007 Kohara ..... 358/498
2007/0069445 A1 * 3/2007 Kakuta ..... 271/3.14
2007/0081212 A1 * 4/2007 Tonami et al. ..... 359/197
2007/0284811 A1 * 12/2007 Nakazawa et al. ..... 271/242
2008/0239415 A1 * 10/2008 Nakamura et al. ..... 358/498

FOREIGN PATENT DOCUMENTS

JP 03143850 A * 6/1991 ..... B65H 5/36
JP 05186090 A * 7/1993 ..... B65H 7/02
JP 2000341471 12/2000
JP 2005-184625 7/2005
JP 2007074399 3/2007

* cited by examiner

*Primary Examiner* — Prasad Gokhale
(74) *Attorney, Agent, or Firm* — Gerald E. Hespos; Michael J. Porco; Matthew T. Hespos

(57) ABSTRACT

An automatic document feeder (10) includes an automatic document feeder main body (11) arranged openable and closeable relative to the document reading surface (2*b*) and feeding the document to the document reading surface (2*b*) when closed to be set to a reading posture, a document guiding member (20) so supported by the automatic document feeder main body (11) as to be movable relative to the automatic document feeder main body (11), and a detecting unit for detecting a relative position of the document guiding member (20) with respect to the automatic document feeder main body (11) when the automatic document feeder main body (11) is set in the reading posture.

9 Claims, 9 Drawing Sheets

AUTOMATIC DOCUMENT FEEDER AND IMAGE FORMING APPARATUS PROVIDED WITH SUCH AUTOMATIC DOCUMENT FEEDER

BACKGROUND OF THE INVENTION

1. Field of the Invention

The present invention relates to an automatic document feeder arranged openable and closeable relative to an image reading unit and an image forming apparatus provided with such automatic document feeder, and more particularly to an automatic document feeder capable of reading a document in a reading posture set when closed and an image forming apparatus provided with such automatic document feeder.

2. Description of the Related Art

The vicinity of an automatic document feeder 100 used in an image forming apparatus is constructed as shown in FIG. 8. Specifically, the automatic document feeder 100 is openably and closeably arranged on an upper part of an image forming apparatus main body 110 where an image reading unit is built in. A lower surface 101 of the automatic document feeder 100 faces an upper surface 111 of the image forming apparatus main body 110 when the automatic document feeder 100 is closed. The automatic document feeder 100 includes a document placing portion 102 on which documents to be read are placed and a document discharging portion 103 located below the document placing portion 102. The automatic document feeder 100 supplies, in the closed state, a document placed on the document placing portion 102 to a narrow document reading surface (contact glass) 112 provided in the upper surface 111 of the image forming apparatus main body 110 for automatically reading the document and discharges the document to the document discharging portion 103. A wide document placing surface (contact glass) 113 is provided separately from the document reading surface (contact glass) 112 in the upper surface 111 of the image forming apparatus main body 110 so that a document can be read without using the automatic document feeder 100.

In the automatic document feeder 100 so constructed, if a thick document such as a book is left on the document placing surface 113 of the image forming apparatus main body 110, the lower surface 101 of the automatic document feeder 100 is lifted up from the upper surface 111 of the image forming apparatus main body 110, causing a problem of a paper jam. This is described in detail below. As shown in FIG. 9, a document fed to the document reading surface 112 and then to be read is discharged to the document discharging portion 103 via two scoop-up guides 114, 104 disposed near the document reading surface 112. The scoop-up guide 114 is disposed in the image forming apparatus main body 110, and the scoop-up guide 104 is disposed in the automatic document feeder 100. Thus, if the lower surface 101 of the automatic document feeder 100 is lifted up from the upper surface 111 of the image forming apparatus main body 110, a bottom end 104*a* of the scoop-up guide 104 comes to be located higher than an upper end 114*a* of the scoop-up guide 114. As a result, the document guided by the scoop-up guide 114 slips into a space under the scoop-up guide 104 to cause a paper jam.

Accordingly, it can be thought to prevent the occurrence of a paper jam by detecting the above lifting of the automatic document feeder 100. One of known technologies applicable to detect the lifting is such that an open/close sensor is disposed near a hinge openably and closeably supporting an automatic document feeder relative to an image forming apparatus main body and the operation of the automatic document feeder is stopped when it is detected by the open/close sensor that the automatic document feeder is lifted without being completely closed (see, for example, Japanese Unexamined Patent Publication No. 2005-184625).

By applying the above technology to the detection of the lifting, the occurrence of a paper jam resulting from a book left behind can be prevented.

However, since the open/close sensor is disposed near the hinge where a height change of the automatic document feeder relative to an angular change thereof is small, accuracy in detecting the lifting of the automatic document feeder is low. Thus, if even a thin book which would not cause any paper jam is left on the document placing surface of the image forming apparatus main body, there is a possibility of stopping the operation of the automatic document feeder, which makes the image forming apparatus inconvenient.

In the above Japanese Unexamined Patent Publication No. 2005-184625, it is also disclosed to use an angle sensor in addition to the open/close sensor. However, the use of the angle sensor is not enough to cope with a situation where such a thin book as not to cause any paper jam is left behind. In other words, it is difficult to detect the lifting of the automatic document feeder by the angle sensor since an angular change of the automatic document feeder is too small at a height to which the automatic document feeder is lifted up when such thin book is left behind.

SUMMARY OF THE INVENTION

In view of such problems residing in the prior art, an object of the present invention is to provide an easy-to-use automatic document feeder which allows a document to be read even when a thin book which would not cause any paper jam is left behind and which has improved accuracy in detecting a lifting of the automatic document feeder. A further object of the present invention is to provide an image forming apparatus equipped with such automatic document feeder.

In order to achieve the above objects, the present invention provides an automatic document feeder for feeding a document to an image reading unit adapted to read an image of the document passing a document reading surface. The automatic document feeder includes an automatic document feeder main body arranged openable and closeable relative to the document reading surface and feeding the document to the document reading surface when closed to be set to a reading posture, and a document guiding member mounted on the automatic document feeder main body at a position facing the document reading surface when the automatic document feeder main body is set in the reading posture, and including a guiding portion for guiding to the document reading surface the document being fed and a contact portion that comes into contact with the document reading surface to define a gap between the guiding portion and the document reading surface. The document guiding member is so supported by the automatic document feeder main body as to be movable relative to the automatic document feeder main body. The automatic document feeder further includes a detecting unit for detecting a relative position of the document guiding member with respect to the automatic document feeder main body when the automatic document feeder main body is set in the reading posture.

These and other objects, features, aspects and advantages of the present invention will become more apparent upon a reading of the following detailed description with reference to accompanying drawings.

DETAILED DESCRIPTION OF THE PREFERRED EMBODIMENTS

Hereinafter, the present invention is specifically described.

Figure 1:
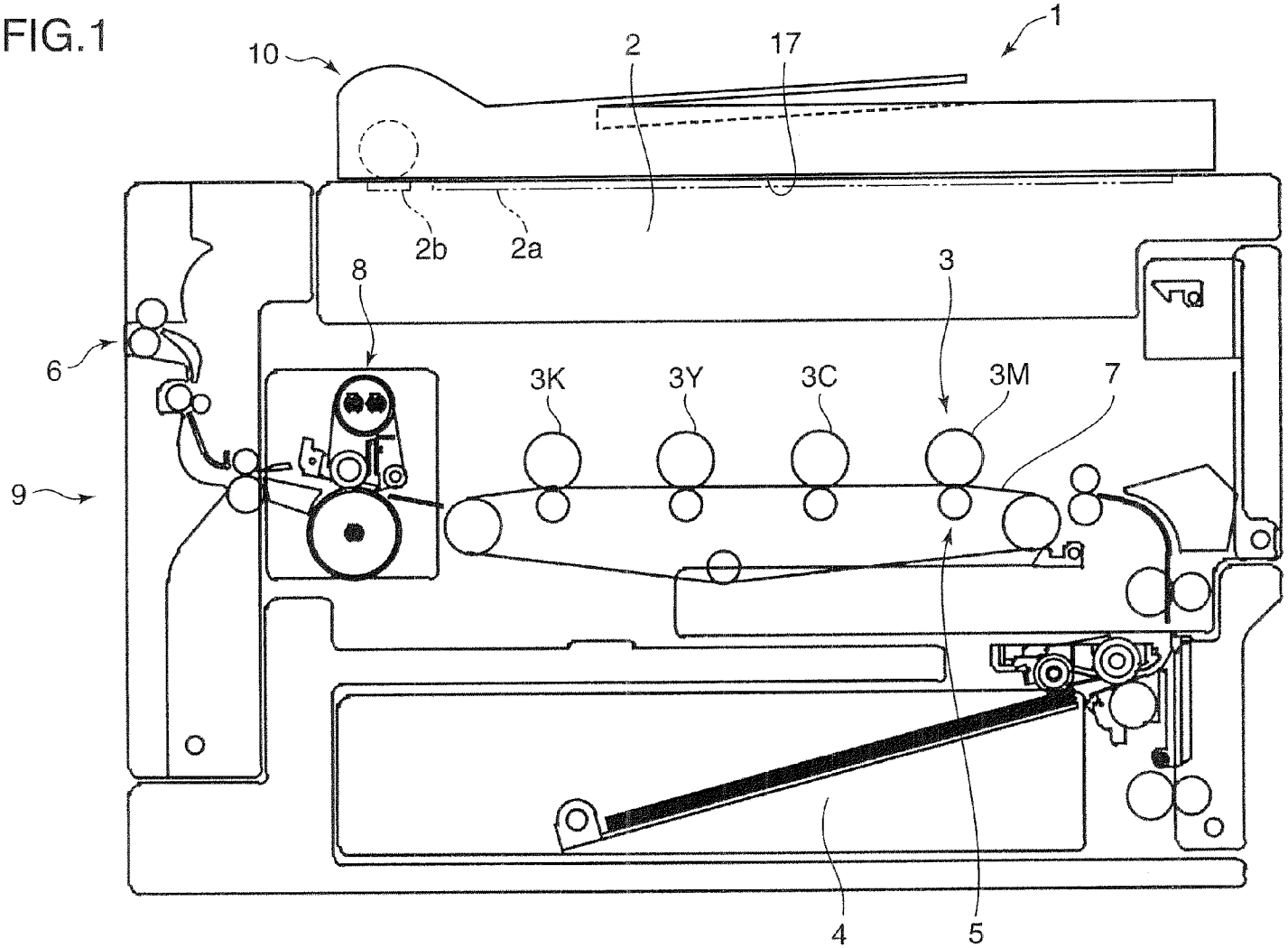
FIG. 1 is a front view in section showing the internal construction of an image forming apparatus including an automatic document feeder according to the invention.

FIG. 1 is a front view in section showing the internal construction of an image forming apparatus including an automatic document feeder according to the embodiment of the present invention.

An image forming apparatus 1 is shown as a copier provided with an image forming apparatus main body 9 and an automatic document feeder 10 arranged atop the image forming apparatus main body 9. The image forming apparatus main body 9 includes an image reading unit 2 arranged in an upper portion of the image forming apparatus main body 9 for reading a document fed by the automatic document feeder 10, an image forming station 3 arranged below the image reading unit 2 for forming a toner image from the content of the read document, a sheet feeding unit 4 arranged below the image forming station 3 for feeding a transfer sheet (recording medium) to the image forming station 3, a transfer unit 5 for transferring the toner image onto the transfer sheet, a fixing unit 8 for fixing the transferred toner image and a discharging unit 6 for discharging to the outside the transfer sheet having the toner image fixed thereto. The image forming apparatus 1 of this embodiment is for color images, and the image forming station 3 id designed such that a magenta unit 3M, a cyan unit 3C, a yellow unit 3Y and a black unit 3K are successively arranged from an upstream side (right side in FIG. 1) to a downstream side (left side in FIG. 1) along a rotation direction of a conveyor belt 7. The image forming station 3 and the transfer unit 5 form an image forming unit.

The image reading unit 2 has an upper surface formed with a document reading surface for reading an image of a document. This document reading surface includes a narrow document reading surface (contact glass) 2*b* for reading a document fed from the automatic document feeder 10 and a wide document placing surface (contact glass) 2*a* arranged in parallel with the document reading surface 2*b*. A book or document is placed on the document placing surface 2*a* by a user to have the image thereof read. It is to be noted that the document placing surface 2*a* is a first reading surface and the document reading surface 2*b* is a second reading surface.

Figure 2:
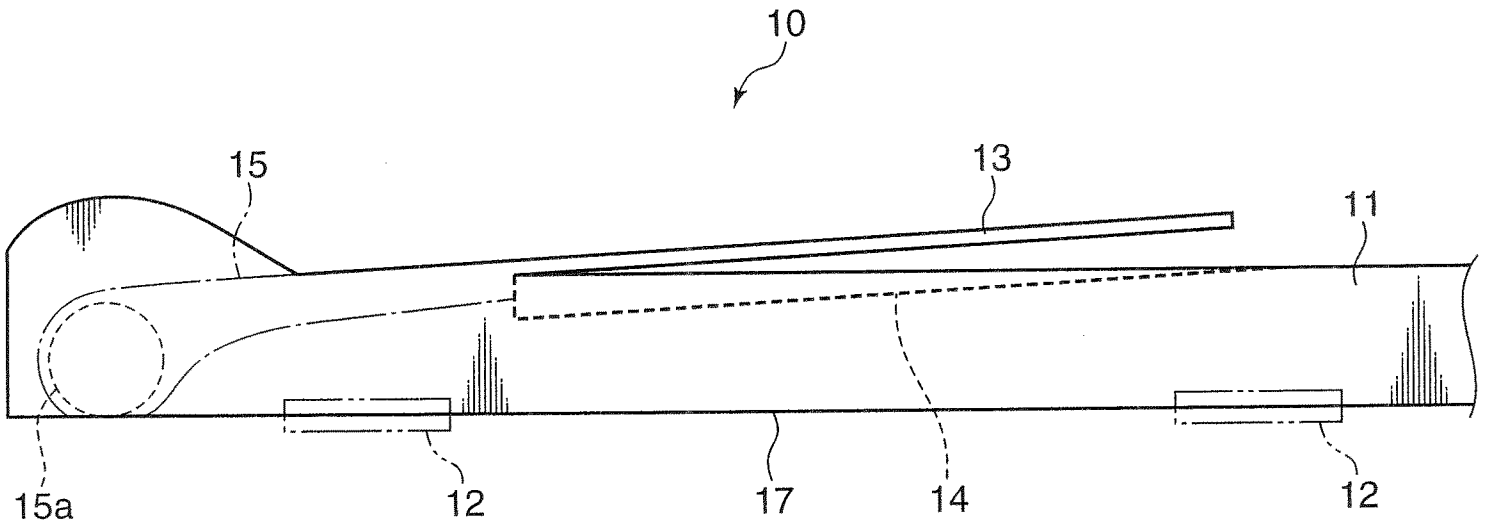
FIG. 2 is a front view in section showing the automatic document feeder.
Figure 3:
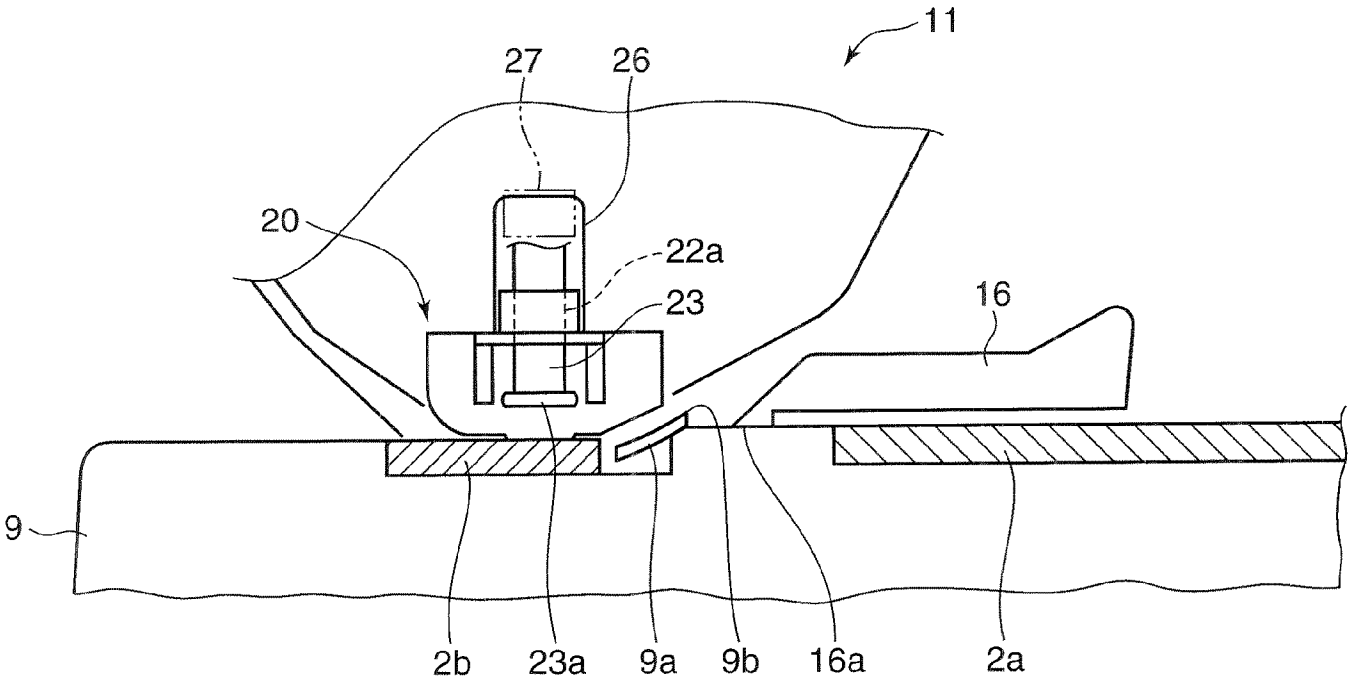
FIG. 3 is a front view in section of a document guiding member as an essential part of the automatic document feeder, showing a state where an automatic document feeder main body is in contact with a document placing surface.
Figure 4:
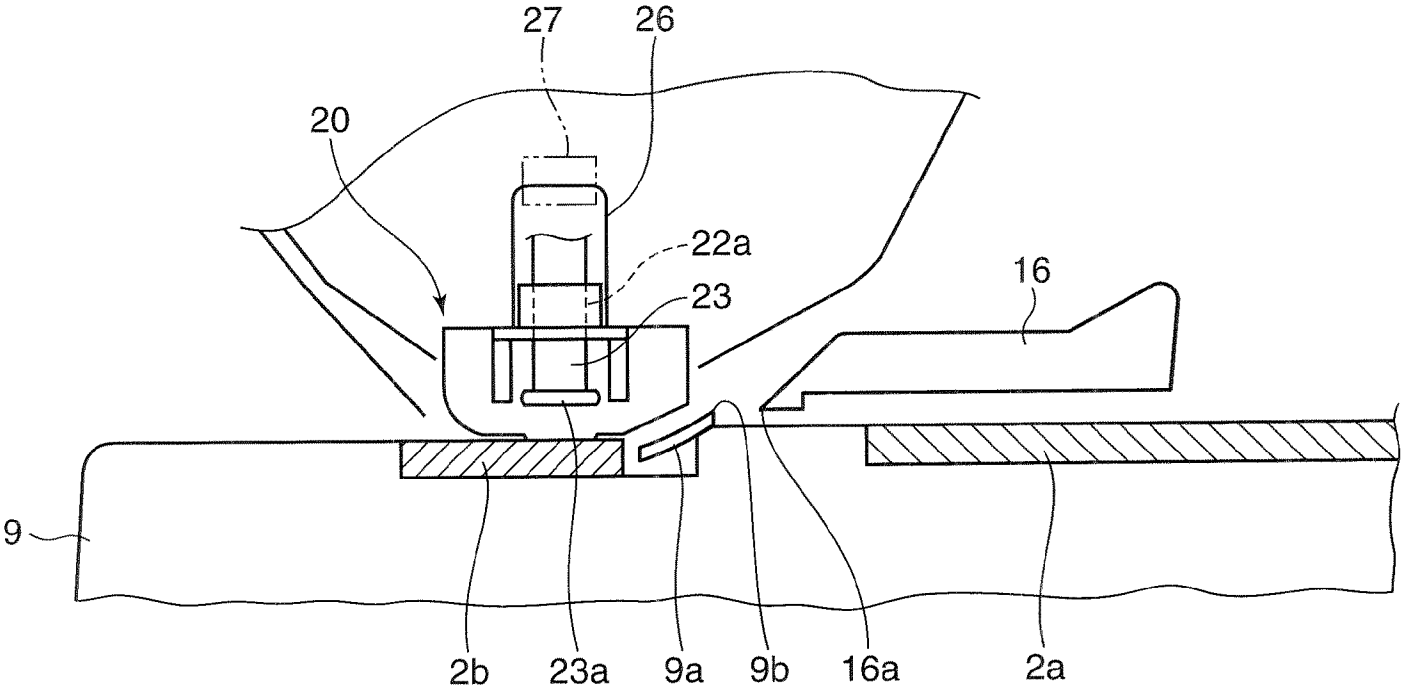
FIG. 4 is a front view in section of the document guiding member as the essential part of the automatic document feeder, showing a state where the automatic document feeder main body is lifted up from the document placing surface.
Figure 5:
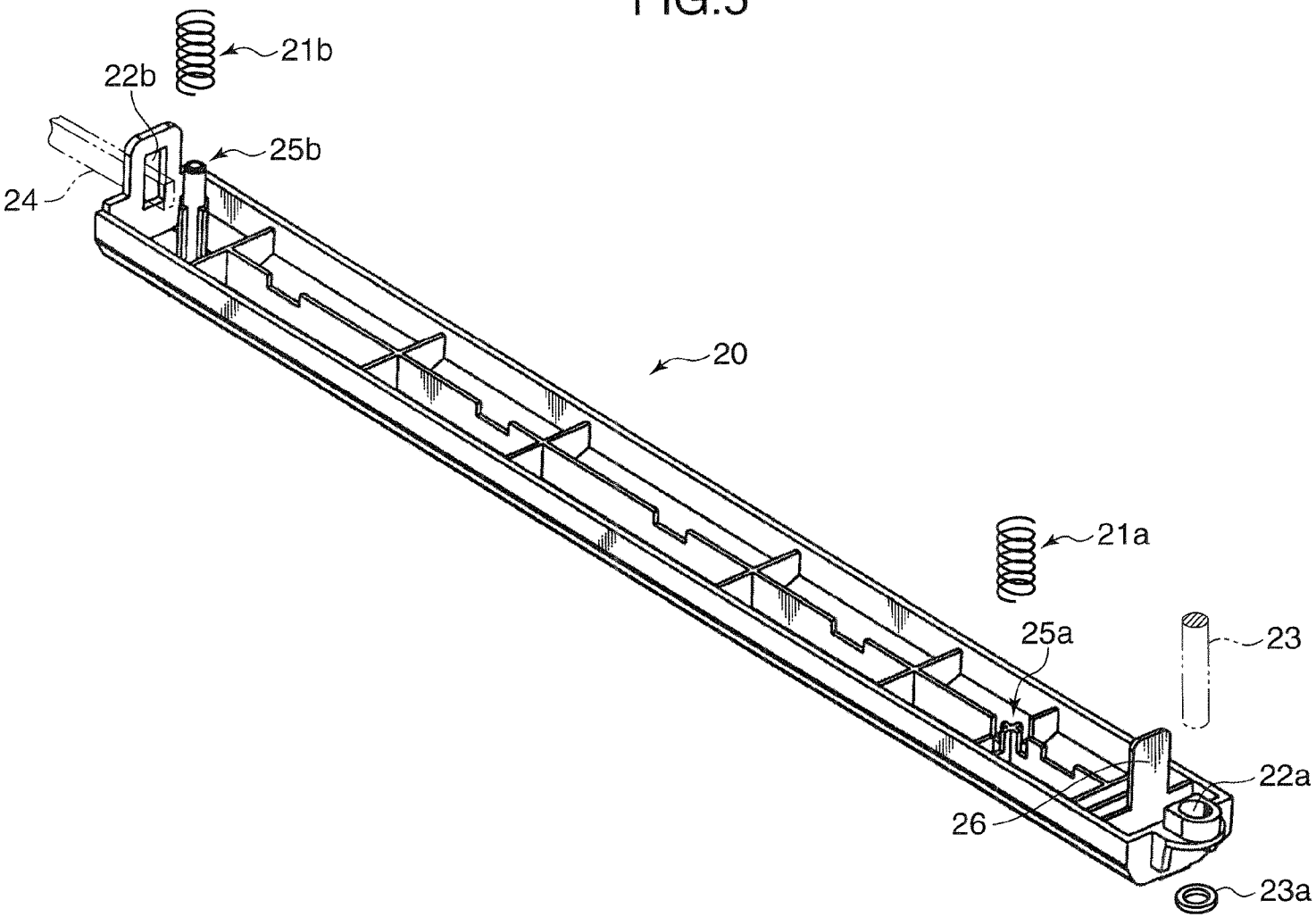
FIG. 5 is an exploded perspective view of the document guiding member showing the mounting thereof.

FIG. 2 is a front view in section showing the automatic document feeder, FIGS. 3 and 4 are front views in section showing a document guiding member as an essential part of the automatic document feeder, FIG. 5 is an exploded perspective view of the document guiding member showing the mounting thereof. FIG. 3 shows a state where the automatic document feeder main body is in contact with the document placing surface and FIG. 4 shows a state where the automatic document feeder main body is lifted up from the document placing surface.

The automatic document feeder 10 includes an automatic document feeder main body 11 having a housing with a first side and a second side opposed to the first side. In this embodiment, the first side forms a rear portion of the automatic document feeder main body 11 whereas the second side forms a front portion of the automatic document feeder main body 11. The rear portion of the automatic document feeder main body 11 is coupled to a hinge 12 mounted on a back side of the image forming apparatus main body 9, and serves as a pivot portion for opening and closing of the automatic document feeder main body 11 relative to the document reading surface. The automatic document feeder main body 11 includes a document placing portion 13 on which a document to be read is placed, and a document discharging portion 14 located below the document placing portion 13.

The feed of a document placed on the document placing portion 13 is started by operating a specified button when the automatic document feeder main body 11 is set in a reading posture by closing thereof, and the document is automatically fed via a conveyance line 15. The document is read by the image reading unit 2 upon passing the document reading surface 2*b* and then discharged onto the document discharging portion 14 via two scoop-up guides 9*a*, 16. A plurality of conveyor rollers are arranged along the conveyance line 15 and a conveyor roller 15*a* shown in FIG. 2 is one of them.

The scoop-up guide 9*a* is fixed to the image forming apparatus main body 9, and the other scoop-up guide 16 is fixed to the automatic document feeder main body 11. Thus, if a book or a thick document is left on the document placing surface 2*a*, the height position of the scoop-up guide 9*a* does not change, but the scoop-up guide 16 is lifted up to a height corresponding to a lifting of the automatic document feeder main body 11 caused by the thickness of the book or the document. The height position of the scoop-up guide 16 is set such that a bottom end 16*a* thereof is slightly lower than an upper end 9*b* of the scoop-up guide 9*a* in a state where the automatic document feeder main body 11 is not lifted up as shown in FIG. 3.

The automatic document feeder main body 11 has a lower surface provided with a document presser 17 at a position facing the document placing surface 2*a*. The document presser 17 is brought into contact with a document or book placed on the document placing surface 2*a* when the automatic document feeder main body 11 is closed to be set in the reading posture. The lower surface of the automatic document feeder main body 11 is also provided with a document guiding member (reading guide member) 20 at a position facing the document reading surface 2*b* when the automatic document feeder main body 11 is closed to be set to the reading posture. This document guiding member 20 extends in a width direction of a document, and is pressed toward the document reading surface 2*b* by coil springs 21*a*, 21*b* disposed at opposite longitudinal ends thereof. Identified by 25*a* in FIG. 5 is a mounting portion on which the coil spring 21*a* is mounted, and identified by 25*b* is a mounting portion on which the coil spring 21*b* is mounted. Lower surfaces of the opposite ends of the document guiding member 20 serve as a contact portion projecting more downward than that of a central part thereof, so that the opposite ends come into contact with the document reading surface 2*b* when the automatic document feeder main body 11 is set to the reading posture. The document passes a gap, defined by the contact portion, between the central part and the document reading surface 2*b*. The central part serves as a guiding portion for guiding a document to the document reading surface 2*b*.

Further, guide holes 22*a*, 22*b* having different shapes are formed in the opposite ends of the document guiding member 20. The guide hole 22*a* is arranged at a front side of the document guiding member 20 and extends vertically, and a vertically long guide bar 23 fixed to the automatic document feeder main body 11 is inserted into the guide hole 22*a*. This guide bar 23 has, for example, an upper end fixed to the automatic document feeder main body 11, and a lower end provided with an annular detachment preventing member 23*a* at a position below the guide hole 22*a*. Thus, the front end of the document guiding member 20 is vertically movable along the guide bar 23.

The other guide hole 22*b* is a through hole arranged at a rear side of the document guiding member 20, penetrating in forward and rearward directions and extending vertically. A guide piece 24 horizontally projecting from the automatic document feeder main body 11 is inserted into this guide hole 22*b*. Thus, the rear end of the document guiding member 20 is vertically movable along the guide piece 24. In this way, the document guiding member 20 is entirely movable in the vertical direction, therefore being movable toward and away from the document reading surface 2*b*.

Further, a detectable portion 26 is disposed near the front end of the document guiding member 20. This detectable portion 26 projects upward to have a specific height and functions as a light interrupting portion.

Figure 6:
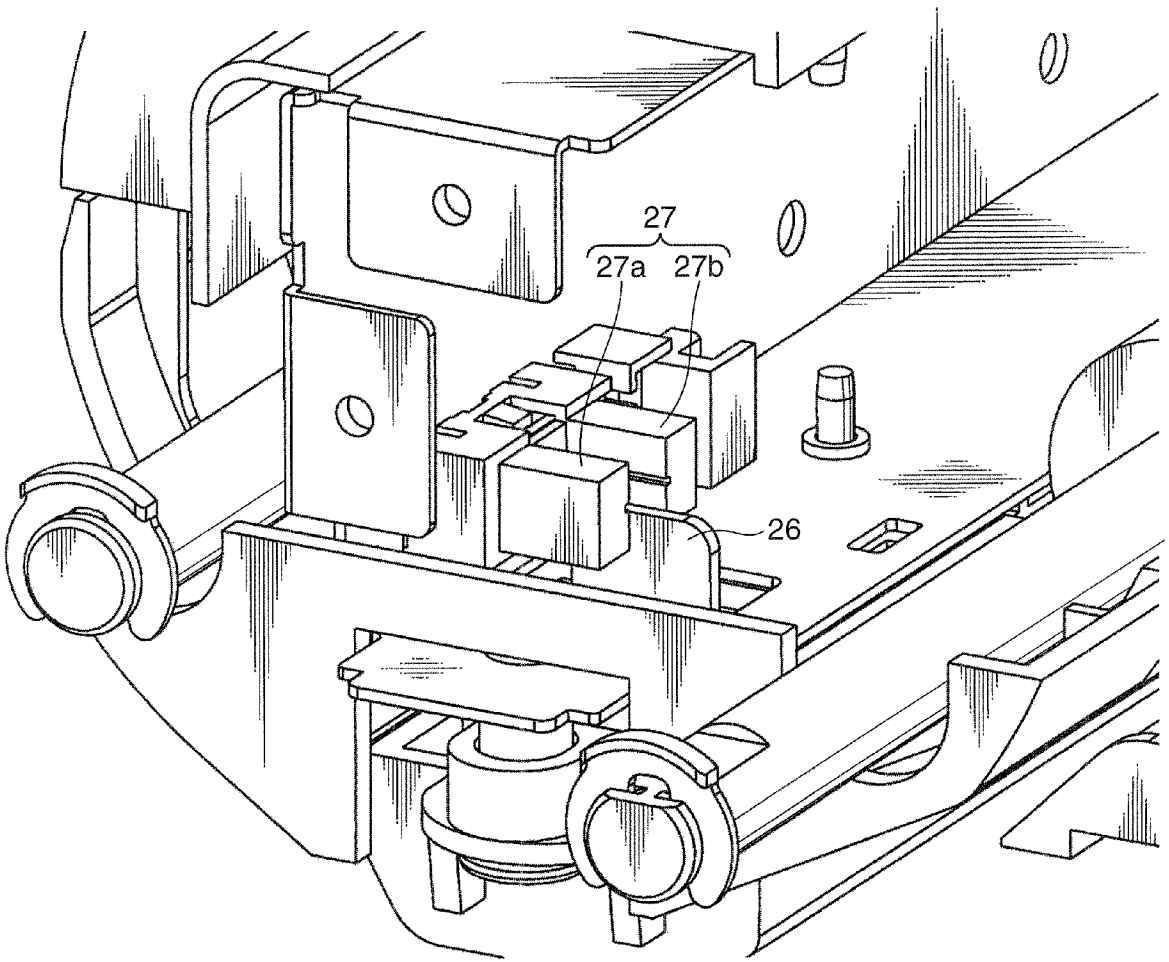
FIG. 6 is a perspective view of a detector and a detectable portion showing a state where the automatic document feeder main body is lifted up.
Figure 7:
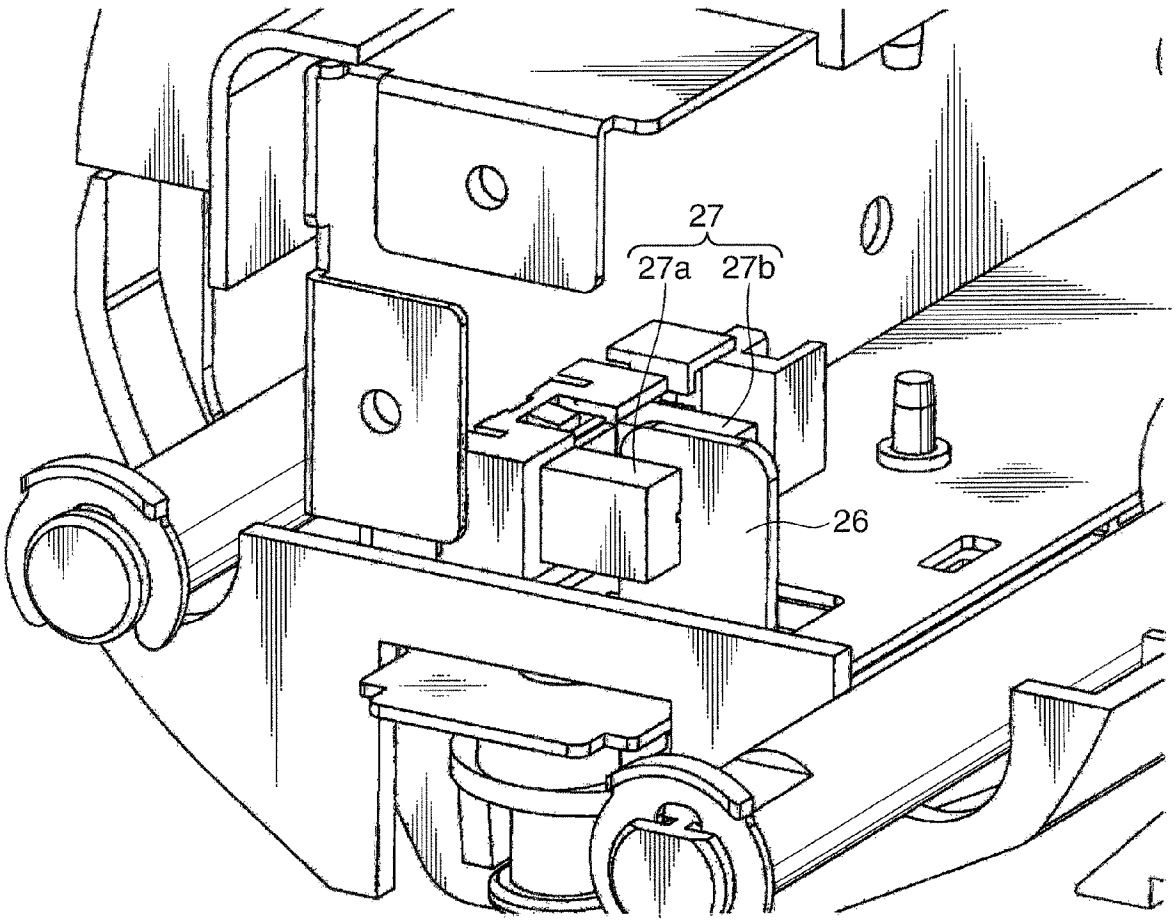
FIG. 7 is a perspective view of the detector and the detectable portion showing a state where the automatic document feeder main body is not lifted up.
Figure 8:
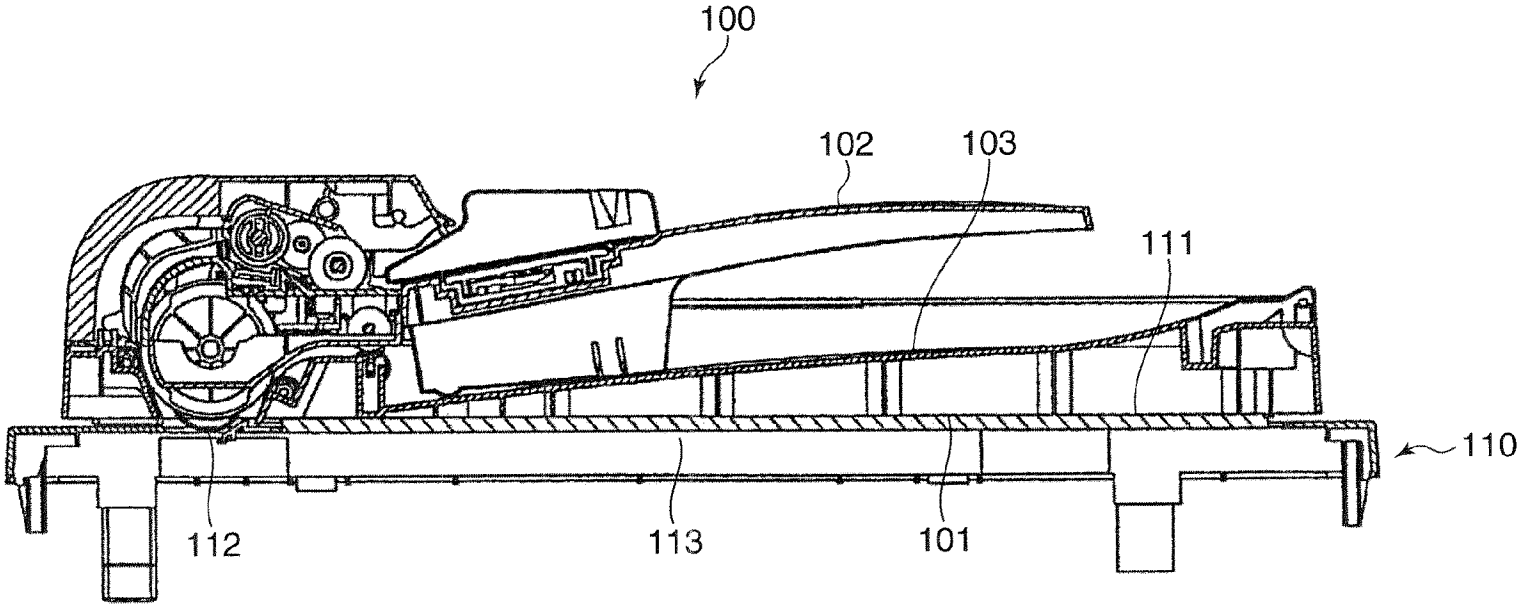
PRIOR ART FIG.8
FIG. 8 is a front view in section showing the construction of a conventional automatic document feeder.
Figure 9:
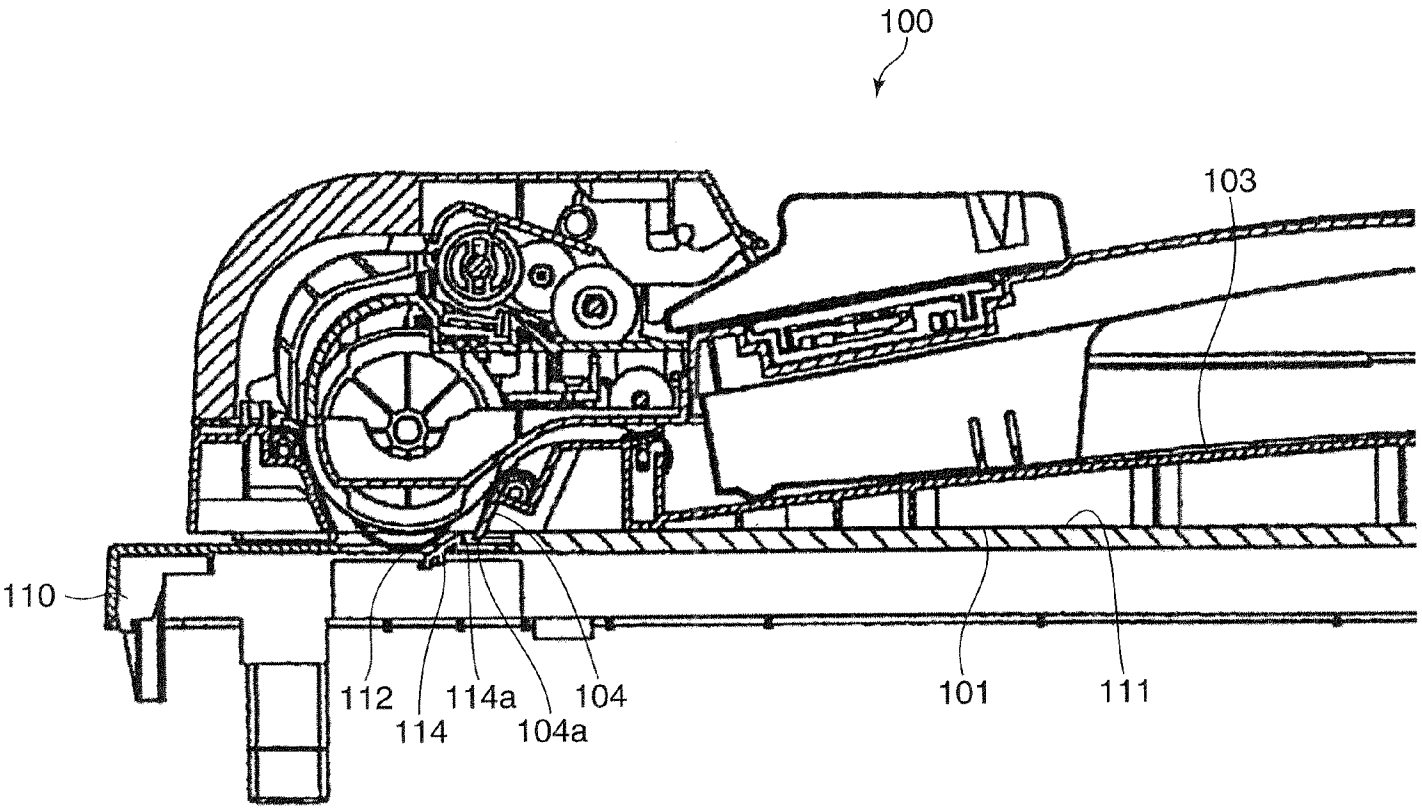
PRIOR ART FIG.9
FIG. 9 is a front view in section enlargedly showing a part of FIG. 8.

FIGS. 6 and 7 are perspective views showing a detector 27 disposed near the detectable portion 26. FIG. 6 shows a state where the automatic document feeder main body 11 is lifted up and FIG. 7 shows a state where the automatic document feeder main body 11 is not lifted up.

The detector 27 is, in this embodiment, a light transmitting sensor including a light emitting element 27*a* and a light receiving element 27*b* and is fixed at a suitable portion of the automatic document feeder main body 11 so that the detectable portion 26 can be detected between the light emitting element 27*a* and the light receiving element 27*b*. The detectable portion 26 and the detector 27 form a detecting unit. If a light emitted from the light emitting element 27*a* toward the light receiving element 27*b* is interrupted by the detectable portion 26 functioning as the light interrupting portion, it is detected that a lifting of the automatic document feeder main body 11 has not exceeded a permissible height position. Conversely, if a light emitted from the light emitting element 27*a* toward the light receiving element 27*b* is not interrupted by the detectable portion 26, it is detected that a lifting of the automatic document feeder main body 11 has exceeded the permissible height position. A paper jam occurs if the lifting of the automatic document feeder main body 11 exceeds the permissible height position.

Here, the permissible height position is, in the automatic document feeder 10 of this embodiment, a height position where the automatic document feeder main body 11 is lifted up from the document placing surface 2*a*, for example, to such an extent that the bottom end 16*a* of the scoop-up guide 16 is lifted up substantially to the same height as the upper end 9*b* of the scoop-up guide 9*a* with respect to the document placing surface 2*a*. Accordingly, a light emitted from the light emitting element 27*a* toward the light receiving element 27*b* is not interrupted by the detectable portion 26 when the bottom end 16*a* of the scoop-up guide 16 comes to or above the same height as the upper end 9*b* of the scoop-up guide 9*a*, whereas the light emitted from the light emitting element 27*a* toward the light receiving element 27*b* is interrupted by the detectable portion 26 when the bottom end 16*a* of the scoop-up guide 16 is positioned below the upper end 9*b* of the scoop-up guide 9*a*. A detection signal from the detector 27 is inputted, for example, to a controller (not shown) for controlling the image forming apparatus main body 9. This controller stops the automatic document feeder main body 11 so as to prevent the occurrence of a paper jam upon receiving the signal indicating that the lifting of the automatic document feeder main body 11 has exceeded the permissible height position.

According to the automatic document feeder 10 of this embodiment so constructed, the lower surfaces of the opposite ends of the document guiding member 20, which is disposed to be vertically movable relative to the automatic document feeder main body 11, are in contact with the document reading surface 2*b* when the automatic document feeder main body 11 is in the reading posture. At this time, when a document is left on the document placing surface 2*a*, the automatic document feeder main body 11 is lifted up beyond the height position taken when it is completely closed without any document being left behind. Thus, the height position of the document guiding member 20 relative to the automatic document feeder main body 11 relatively changes, according to the thickness of the document left, in a direction in which the document guiding member 20 approaches to the document reading surface 2*b* and in a direction in which the document guiding member 20 separates or moves away from the document reading surface 2*b*. The detector 27 detects this relative height position of the document guiding member 20 based on the light interrupting by the detectable portion 26, and detects the lifting of the lower surface of the automatic document feeder main body 11 from the upper surface of the image forming apparatus main body 9 based on this detection. Thus, if the relative height position of the document guiding member 20 with respect to the automatic document feeder main body 11 is lower than the permissible height position where no paper jam occurs, the document is read by the automatic document feeder 10. Thus, the automatic document feeder 10 and, consequently, the image forming apparatus 1 can be made easy-to-use. Further, the detectable portion (light interrupting portion) 26 of the document guiding member 20 is arranged near the scoop-up guides 9*a*, 16 that determine whether or not a paper jam caused by a lifting of the automatic document feeder main body 11 occurs, and the detector 27 detects the lifting of the automatic document feeder main body 11 using the detectable portion 26 as a detection object. Therefore, accuracy in detecting the lifting of the automatic document feeder main body 11 can be improved. In this embodiment, the document reading surface 2*b* serves as a reference surface used by the detecting unit in detecting the relative height position of the document guiding member 20 with respect to the automatic document feeder main body 11.

Further, since the automatic document feeder main body 11 is arranged such that the rear portion thereof serves as a pivot portion for opening and closing movements of the automatic document feeder main body 11 whereas the front portion thereof is openable and closeable relative to the image forming apparatus main body 9, the vertical movement of the front portion is larger in relation to an angular change than that of the rear portion. Also, since the detecting unit including the detector 27 and the detectable portion 26 is arranged at the front portion having large change in vertical movement, the accuracy in detecting the lifting of the automatic document feeder main body 11 can be further improved. In the case of arranging the detecting unit at the front portion, the reference surface is preferably set at the front part of the document reading surface 2*b*.

Although the lifting of the automatic document feeder main body 11 is detected when the optical sensor 27 detects the light interruption in the above embodiment, it may be, conversely, detected when the optical sensor 27 detects the light transmission. Alternatively, a reflective optical sensor may be used in the present invention.

Although the automatic document feeder 10 is applied to the image forming apparatus as a copier in the above embodiment, the present invention is not limited to this and the automatic document feeder 10 may be similarly applied to a scanner (image reading apparatus), a facsimile machine or a copier provided with such a scanner or a complex image forming apparatus having a facsimile function or a copy function.

In the case of applying the automatic document feeder 10 to an image reading apparatus, the image reading apparatus may be constructed as follows. Specifically, the image reading apparatus includes an image reading unit having an upper surface provided with a document reading surface for reading a document, an automatic document feeder arranged openable and closeable relative to the upper surface of the image reading unit, and having a lower surface facing the upper surface of the image reading unit when closed to be set to a reading posture, the automatic document feeder feeding the document to the document reading surface when set in the reading posture, and a reading guide member mounted on the lower surface of the automatic document feeder for guiding to the document reading surface the document being fed. The reading guide member is able to come into contact with a predetermined reference surface defined on the upper surface of the image reading unit when the automatic document feeder is set in the reading posture, and also able to move relative to the automatic document feeder in a vertical direction with respect to the reference surface. The image reading apparatus further includes a detecting unit for detecting a height of the lower surface of the automatic document feeder from the reference surface by detecting the relative position of the reading guide member with respect to the automatic document feeder in the vertical direction when the automatic document feeder is set in the reading posture.

The automatic document feeder described above has the following construction.

Then automatic document feeder is for feeding a document to an image reading unit adapted to read an image of the document passing a document reading surface. The automatic document feeder includes an automatic document feeder main body arranged openable and closeable relative to the document reading surface and feeding the document to the document reading surface when closed to be set to a reading posture, and a document guiding member mounted on the automatic document feeder main body at a position facing the document reading surface when the automatic document feeder main body is set in the reading posture, and including a guiding portion for guiding to the document reading surface the document being fed and a contact portion that comes into contact with the document reading surface to define a gap between the guiding portion and the document reading surface. The document guiding member is so supported by the automatic document feeder main body as to be movable relative to the automatic document feeder main body. The automatic document feeder further includes a detecting unit for detecting a relative position of the document guiding member with respect to the automatic document feeder main body when the automatic document feeder main body is set in the reading posture.

According to the automatic document feeder constructed as above, the document guiding member, which is disposed to be movable relative to the automatic document feeder main body, comes into contact with the document reading surface when the automatic document feeder main body is in the reading posture. If a document is left on the document reading surface in this reading posture, the automatic document feeder main body is lifted up by the thickness of the document left behind from a height position thereof when the automatic document feeder main body is completely closed without any document being left behind. Thus, the relative position of the document guiding member with respect to the automatic document feeder main body changes according to the thickness of the document left behind. The detecting unit detects the lifting of the automatic document feeder main body relative to the document reading surface based on the relative positional change of the document guiding member. Therefore, the automatic document feeder can be made easy-to-use by designing the automatic document feeder to feed the document as long as the magnitude of the relative positional change of the document guiding member is equal to or below a predetermined value where no paper jam occurs.

In the above construction, the detecting unit includes a light interrupting portion disposed in the document guiding member and an optical sensor disposed in the automatic document feeder main body and detects a lifting of the automatic document feeder main body from the document reading surface based on whether or not a light from the optical sensor has been interrupted by the light interrupting portion.

According to the above construction, the lifting of the automatic document feeder main body can be detected based on the relative position of the document guiding member with respect to the automatic document feeder main body. In other words, the lifting of the automatic document feeder main body can be detected based on the relative position of the light interrupting portion with respect to the optical sensor. Specifically, no lifting of the automatic document feeder main body from the document reading surface is detected when the light from the optical sensor is interrupted by the light interrupting portion at the above relative position while detecting the lifting of the automatic document feeder main body when the light from the optical sensor is not interrupted by the light interrupting portion.

In the above construction, the automatic document feeder main body includes a housing having a first side and a second side opposed to the first side. The first side is formed as a pivot portion enabling the pivotal opening and closing of the automatic document feeder main body relative to the document reading surface, and the second side is provided with the detecting unit.

According to this construction, since the first side of the automatic document feeder main body serves as a pivot portion for the opening and closing of the automatic document feeder main body relative to the document reading surface, the second side of the automatic document feeder main body undergoes larger change in vertical movement in relation to angular change than the first side. Thus, the accuracy of detecting the lifting of the automatic document feeder main body can be further improved by arranging the detecting unit at the second side.

In the above construction, the document reading surface includes a first reading surface for reading a document to be placed thereon and a second reading surface for reading a document automatically fed. The relative position of the document guiding member differs depending on whether or not the document is placed on the first reading surface.

In the above construction, the automatic document feeder further includes a document presser arranged on a lower surface of the automatic document feeder main body to face the first reading surface. The document presser comes into contact with a document placed on the first reading surface when the automatic document feeder main body is set in the reading posture.

This application is based on Japanese Patent Application No. 2007-215051 filed in Japan Patent Office on Aug. 21, 2007, the contents of which are hereby incorporated by references.

The present invention has been appropriately and sufficiently described above by way of embodiments with reference to the drawings, but it should be appreciated that a person skilled in the art can easily modify and/or improve the above embodiments. Accordingly, a modified embodiment or improved embodiment carried out by the person skilled in the art should be interpreted to be embraced by the scope as claimed unless departing from the scope as claimed.

What is claimed is:

1. An automatic document feeder for feeding a document to an image reading unit adapted to read an image of the document passing a document reading surface, comprising:

an automatic document feeder main body arranged openable and closeable relative to the document reading surface, the automatic document feeder feeding the document to the document reading surface when the automatic document feeder main body is closed to be set to a reading posture and including a housing having a first side and a second side opposite the first side, the first side defining a pivot portion enabling pivotal opening and closing of the automatic document feeder main body relative to the document reading surface, and first and second guides provided respectively at the first and second sides, the first guide being a guide piece horizontally projecting from the automatic document feeder main body and the second guide being a vertically extending guide bar having an upper end fixed to the automatic document feeder main body;

a document guiding member mounted on the automatic document feeder main body at a position facing the document reading surface when the automatic document feeder main body is set in the reading posture, the document guiding member having a first end in proximity to the first side of the housing and a second end in proximity to the second side of the housing and including a guiding portion for guiding the document being fed to the document reading surface, a contact portion that comes into contact with the document reading surface to define a gap between the guiding portion and the document reading surface, first and second guided members arranged respectively at the first and second ends of the document guiding member, the first guided member being a vertically long first hole penetrating in a direction in which the first and second sides face each other, the guide piece being inserted into the first hole, the second guided member being a second hole penetrating the document guiding member vertically, the guide bar being inserted into the second hole, first and second biasing members disposed respectively at the first and second ends of the document guiding member for biasing the contact portion toward the document reading surface, the first and second ends of the document guiding member being so supported by the automatic document feeder main body as to be movable relative to the automatic document feeder main body, and the first and second guided members at the respective first and second ends of the document guiding member being guided respectively by the first and second guides at the respective first and second sides of the housing for movement toward and away from the reading surface when the automatic document feeder main body is pivoted toward the reading posture; and a detecting unit having a detected portion disposed on the second end of the document guiding member and a detecting member disposed on the second side of the housing of the automatic document feeder main body for detecting the detected portion, wherein, in a state in which the automatic document feeder main body is set to the reading posture, the detecting unit detects no lifting of the automatic document feeder main body from the document reading surface when a relative position between the detecting member and the detected portion is at a first position, and the detecting unit detects a lifting of the automatic document feeder main body from the document reading surface when the relative position between the detecting member and the detected portion is at a second position.

2. An automatic document feeder according to claim 1, wherein the detected portion is a light interrupting portion and the detecting member is an optical sensor, the light interrupting portion and the optical sensor are disposed so that a light emitted from the optical sensor is interrupted by the light interrupting portion when the relative position is at the first position, and the light interrupting portion and the optical sensor are disposed so that the light emitted from the optical sensor is not interrupted by the light interrupting portion when the relative position is at the second position, the detecting unit detects no lifting of the automatic document feeder main body from the document reading surface when the relative position is at the first position, and on the other hand detects the lifting of the automatic document feeder main body from the document reading surface when the relative position is at the second position.

3. An automatic document feeder according to claim 1, wherein the document reading surface includes a first reading surface for reading a document to be placed thereon and a second reading surface for reading a document automatically fed; and wherein, the lifting of the automatic document feeder main body from the first reading surface is detected when the document is placed on the first reading surface and no lifting of the automatic document feeder main body from the first reading surface is detected when no document is placed on the first reading surface.

4. An automatic document feeder according to claim 3, further comprising a document presser arranged on a lower surface of the automatic document feeder main body to face the first reading surface; and wherein the document presser comes into contact with a document placed on the first reading surface when the automatic document feeder main body is set in the reading posture.

5. An image reading apparatus, comprising:

an image reading unit having an upper surface provided with a document reading surface for reading a document;

an automatic document feeder having an automatic document feeder main body arranged openable and closeable relative to the upper surface of the image reading unit, and the automatic document feeder main body having a lower surface facing the upper surface of the image reading unit when closed to be set to a reading posture, the automatic document feeder feeding the document to the document reading surface when set in the reading posture, the automatic document feeder main body including a housing having a first side and a second side opposite the first side, the first side defining a pivot portion enabling pivotal opening and closing of the automatic document feeder main body relative to the document reading surface, and first and second guides provided respectively at the first and second sides, the first guide being a guide piece horizontally projecting from the automatic document feeder main body and the second guide being a vertically extending guide bar having an upper end fixed to the automatic document feeder main body;

a reading guide member mounted on the lower surface of the automatic document feeder main body for guiding to the document reading surface the document being fed, the reading guide member having a first end in proximity to the first side of the housing and a second end in proximity to the second side of the housing, the reading guide member being able to come into contact with a predetermined reference surface defined on the upper surface of the image reading unit when the automatic document feeder is set in the reading posture, and also to move relative to the automatic document feeder in a vertical direction with respect to the reference surface, first and second guided members arranged respectively at the first and second ends of the reading guide member, the first guided member being a vertically long first hole penetrating in a direction in which the first and second sides face each other, the guide piece being inserted into the first hole, the second guided member being a second hole penetrating the document guiding member vertically, the guide bar being inserted into the second hole, first and second biasing members arranged respectively at the first and second ends of the reading guide member for biasing the reading guide member toward the document reading surface and, the first and second guided members at the respective first and second ends of the reading guide member being guided respectively by the first and second guides at the respective first and second sides of the housing for movement toward and away from the reading surface when the automatic document feeder main body is moved toward the reading posture; and a detecting unit having a detected portion disposed on the second end of the reading guide member and a detecting member disposed on the second side of the housing of the automatic document feeder main body for detecting the detected portion, the detecting unit detecting a height of the lower surface of the automatic document feeder main body from the reference surface by detecting the relative position of the reading guide member with respect to the automatic document feeder main body in the vertical direction based on the relative position between the detecting member and the detected portion when the automatic document feeder main body is set in the reading posture.

6. An image forming apparatus, comprising:

an image reading unit having a document reading surface for reading an image of a document;

an automatic document feeder for feeding the document to the image reading unit; and an image forming unit for forming an image on a recording medium based on the read image;

the automatic document feeder including:

an automatic document feeder main body arranged openable and closeable relative to the document reading surface, the automatic document feeder feeding the document to the document reading surface when the automatic document feeder main body is closed to be set to a reading posture, the automatic document feeder main body including a housing having a first side and a second side opposed to the first side, the first side defining a pivot portion enabling pivotal opening and closing of the automatic document feeder main body relative to the document reading surface, and first and second guides provided respectively at the first and second sides, the first guide being a guide piece horizontally projecting from the automatic document feeder main body and the second guide being a vertically extending guide bar having an upper end fixed to the automatic document feeder main body;

a document guiding member mounted on the automatic document feeder main body at a position facing the document reading surface when the automatic document feeder main body is set in the reading posture, the document guiding member having a first end in proximity to the first side of the housing and a second end in proximity to the second side of the housing and including a guiding portion for guiding to the document reading surface the document being fed, a contact portion that comes into contact with the document reading surface to define a gap between the guiding portion and the document reading surface, first and second guided members arranged respectively at the first and second ends of the document guiding member, the first guided member being a vertically long first hole penetrating in a direction in which the first and second sides face each other, the guide piece being inserted into the first hole, the second guided member being a second hole penetrating the document guiding member vertically, the guide bar being inserted into the second hole, first and second biasing members arranged respectively at the first and second ends of the document guiding member for biasing the contact portion toward the document reading surface, the first and second ends of the document guiding member being so supported by the automatic document feeder main body as to be movable relative to the automatic document feeder main body and the first and second guided members at the respective first and second ends of the document guiding member being guided by the first and second guides at the respective first and second sides of the housing for movement toward and away from the reading surface when the automatic document feeder main body is pivoted toward the reading posture; and a detecting unit disposed on the second end of the document guiding member and a detecting member disposed on the second side of the automatic document feeder main body for detecting the detected portion, wherein, in a state in which the automatic document feeder main body is set to the reading posture, the detecting unit detects no lifting of the automatic document feeder main body from the document feeding surface when a relative position between the detecting member and the detected portion is at a first position, and the detecting unit detects a lifting of the automatic document feeder main body from the document reading surface when the relative position between the detecting member and the detected portion is at a second position.

7. An image forming apparatus according to claim 6, wherein the detected portion is a light interrupting portion and the detecting member is an optical sensor, the light interrupting portion and the optical sensor are disposed so that a light emitted from the optical sensor is interrupted by the light interrupting portion when the relative position is at the first position, and the light interrupting portion and the optical sensor are disposed so that the light emitted from the optical sensor is not interrupted by the light interrupting portion when the relative position is at the second position, the detecting unit detects no lifting of the automatic document feeder main body from the document reading surface when the relative position is at the first position, and on the other hand detects the lifting of the automatic document feeder main body from the document reading surface when the relative position is at the second position.

8. An image forming apparatus according to claim 6, wherein the document reading surface includes a first reading surface for reading a document to be placed thereon and a second reading surface for reading a document automatically fed; and wherein, the lifting of the automatic document feeder main body from the first reading surface is detected when the document is placed on the first reading surface, and no lifting of the automatic document feeder main body from the first reading surface is detected when no document is placed on the first reading surface.

9. An image forming apparatus according to claim 8, further comprising a document presser arranged on a lower surface of the automatic document feeder main body to face the first reading surface; and wherein the document presser comes into contact with a document placed on the first reading surface when the automatic document feeder main body is set in the reading posture.

* * * * *